US008487728B2

(12) United States Patent
Bill et al.

(10) Patent No.: US 8,487,728 B2
(45) Date of Patent: Jul. 16, 2013

(54) SAFETY APPARATUS

(75) Inventors: Martin Bill, Nohfelden (DE); Patrik Fuchs, Saarbrücken (DE)

(73) Assignee: Hydac Electronic GmbH, Saarbrucken (DE)

( * ) Notice: Subject to any disclaimer, the term of this patent is extended or adjusted under 35 U.S.C. 154(b) by 35 days.

(21) Appl. No.: 12/452,901

(22) PCT Filed: Jun. 18, 2008

(86) PCT No.: PCT/EP2008/004884

§ 371 (c)(1),
(2), (4) Date: Feb. 22, 2010

(87) PCT Pub. No.: WO2009/015732

PCT Pub. Date: Feb. 5, 2009

(65) Prior Publication Data

US 2010/0156580 A1 Jun. 24, 2010

(30) Foreign Application Priority Data

Jul. 31, 2007 (DE) ..... 10 2007 036 310

(51) Int. Cl.
*H01F 7/00* (2006.01)
*H01F 1/00* (2006.01)

(52) U.S. Cl.
USPC ..... 335/219

(58) Field of Classification Search
USPC ..... 335/219, 220, 250, 282, 299
See application file for complete search history.

(56) References Cited

U.S. PATENT DOCUMENTS

| | | | | | |
|---|---|---|---|---|---|
| 2,956,210 | A | * | 10/1960 | Yatsushiro | 361/38 |
| 4,095,206 | A | * | 6/1978 | Hishiki | 336/96 |
| 4,112,405 | A | * | 9/1978 | Joseph | 337/4 |
| 4,771,198 | A | * | 9/1988 | Aschberger et al. | 310/68 C |
| 5,239,277 | A | * | 8/1993 | Vielot | 335/255 |
| 6,029,947 | A | * | 2/2000 | Sears | 251/149.1 |
| 2004/0157945 | A1 | * | 8/2004 | Barber | 521/155 |
| 2005/0178516 | A1 | * | 8/2005 | Sekikawa et al. | 162/159 |
| 2011/0079427 | A1 | * | 4/2011 | Powale et al. | 174/72 A |

FOREIGN PATENT DOCUMENTS

| | | | |
|---|---|---|---|
| CH | 271 223 | A | 10/1950 |
| DE | 31 32 538 | A1 | 6/1983 |
| DE | 88 06 061 | U1 | 9/1988 |
| DE | 41 26 702 | A1 | 2/1993 |
| DE | 10 2004 017 089 | A1 | 10/2005 |
| DE | 10 2004 056 193 | A1 | 5/2006 |
| DE | 10 2005 056 816 | A1 | 5/2007 |
| GB | 2 256 080 | A | 11/1992 |

* cited by examiner

*Primary Examiner* — Bernard Rojas
(74) *Attorney, Agent, or Firm* — Roylance, Abrams, Berdo and Goodman LLP

(57) ABSTRACT

A safety apparatus for avoiding a possible fire risk in an operating magnet supplied with electric current has at least one coil former (14) arranged in a housing (76, 82). A coil winding (16) is fitted on the coil former and has an operating part (20, 36) at least partially guided in the coil former (14). At least parts of the operating magnet are equipped with active and/or passive safety mechanisms of the apparatus to effectively counteract the risk of fire. The safety mechanisms are no longer arranged remote from the actual event, for example in the form of a fuse in the electrical supply circuit, but rather are directly at the location of the event where the possible fire or scorching situation can directly occur.

17 Claims, 3 Drawing Sheets

SAFETY APPARATUS

FIELD OF THE INVENTION

The invention relates to a safety apparatus for avoiding a potential fire risk in an operating magnet that can be supplied with electric current. At least one coil former is arranged in a housing, with a coil winding being fitted on it. An operating part is at least partially guided in the coil former.

BACKGROUND OF THE INVENTION

Operating magnets suppliable with electric current are readily available on the market in a number of embodiments. By way of example, DE 10 2004 017 089 B4 is representative of the pertinent operating equipment, particularly in the form of a proportional double solenoid. This known solution is used in the operation of valves, with at least two windings on one coil former in each case. The coil windings are arranged in each case between two ring flanges at least partially encasing a pole tube by an anchor part being guided movably. The anchor part undergoes transition into a pole core at its one end via a magnetic separation. In the pole core, an operating plunger is guided as an operating part. At its other end, the anchor part at least partially engages a closing part via another magnetic separation. A disk-shaped pole plate is arranged between the adjacent and opposing coil formers. In the known solution, the pole core, the pole tube, as well as the magnetic separations and the closing part form an assembly, onto which the respective coil former with its coil windings and the pole plate can be slipped as another assembly. To always have a defined securing position, at least one of the facing ring flanges adjacent to one another has a projecting component. The projecting component can be engaged with a corresponding recess in the ring flange of the other coil former. As already mentioned above, such operating magnets are used primarily to control hydraulic valves. However, new technical areas are increasingly opening up for which respective operating magnets can be used advantageously.

Subsequently published DE 10 2005 056 816 shows an unlatching device using an operating magnet for emergency activation of a headrest for a motor vehicle seat. In the event the motor vehicle crashes, the headrest moves forward to reduce the free impact surface between the back of the seat user's head and the impact area of the head on the headrest. To control the unlatching of the headrest, a corresponding control part can be moved along a first axis. In an operating position, that control part enables a swing distance extending crosswise to the first axis for a control device arranged to pivot around a second axis. The respective control device also has a locking part that can be unlatched by the operating part of the magnet via the control device. The pathway for the control part to be triggered then releases in the forward direction for an activation process of the headrest.

The problem common to all operating magnets with their coil windings is that in the event of fault currents, overheating caused by overstraining the magnet, etc., can result in fire. Plastic materials used increasingly for weight and practicality reasons for at least one portion of the components of the operating magnet can be easily scorched or can even burn. That risk increases starting from the electrical coil winding via the plastic parts. A fire has a detrimental effect on other connected components of the technical system, such as valves, headrests, etc. Currently both the housing parts of the operating magnet and their encapsulation are made of plastic.

Other relevant plastic parts are the coil formers for receiving the coil winding and the plastic insulating layers for the wire winding fitted to the coil former, usually designed in the form of copper wire.

Preferably, the copper wire, as a coated electric wire, is encased over its entire length with a plastic coated insulation to have an electric decoupling between the winding layers in the winding. However, the plastic coated insulation is very heat-sensitive, easily scorches through, and thus forms an ideal fire source. To counteract this fire risk in practice, an electric safety device is installed within the electric supply cycle of the coil winding, primarily in the form of a fuse that is to activate, i.e., is to break, the electric circuit as soon as a short-circuit occurs because of scorched parts of the coating insulation. In practice, the cases show that this electric safety device is not sufficient to effectively counteract the potential fire risk. Thus, cases exist in which the fuse indeed activated and nevertheless a (scorching) fire resulted because of a short-circuit, starting from the operating magnet that was used.

SUMMARY OF THE INVENTION

An object, of the invention is to provide improved safety devices avoiding scorching and the progression to a fire starting from an operating magnet that is used.

This object is basically achieved with a safety apparatus according to the invention, where at least portions of the operating magnet are equipped with active and/or passive safety devices to counteract the fire risk effectively. The safety devices are no longer outside of the actual event, for example arranged in the form of a fuse in the electrical supply circuit. Rather, the safety devices are directly on site where the potential fire or scorching situation can occur directly. Without a significant delay and by a direct influence, the safety apparatus becomes an integrated component of the operating magnet. Independently, to increase safety, additional electric safety devices, such as conventional fuses, can be provided in the electric circuit and may already be provided on site in the existing electric circuits. An especially reliable, redundant safety design is produced.

In a preferred embodiment of the safety apparatus according to the invention, an extinguishing medium is used as an active safety means, such as extinguishing foam, extinguishing gas or extinguishing fluid with inclusion of nanoparticulate extinguishing substances. In addition to the active safety devices for which a storage space is preferably provided within the operating magnets, passive safety devices can also be used, so that the passive safety devices are integrated parts of components of the operating magnets. The plastic parts of the operating magnets can be equipped with flame-resistant or flame-retardant active substances, or existing systems can be retrofitted.

In an especially preferred embodiment of the safety apparatus according to the invention, the safety devices are used that produce of a type of scoring for creating an early, non-critical failure case for the operating magnets. For inducing the early failure case, an electrical short-circuit of the coil winding is created. The coil winding is selected from an insulating material class for the material of its sheathing, which sheathing melts in time before reaching the critical temperature for a fire. While a very heat-resistant coating insulation according to DIN EN 60317 is normally selected in the prior art for the copper wire of the coil winding to ensure high operating safety and relies on the fuse responding quickly, which cannot be ensured, as explained, the safety apparatus according to the invention takes a different approach by a coating insulation for the coil wire having a low softening temperature. If even just a little warmth or heat develops within presettable limits, a desired burning-through of the adjacent insulating layers occurs.

This desired burning-through of the insulating layers causes the coil winding to be melted together, at least partially, to form a copper block of the individual winding layers. The block is then not easily destroyed by heat and particularly disables the operating magnets, also affecting additional current draw. Practical tests have shown that the safety apparatus according to the invention manages even without the additional fuse solution in the electric supply circuit for the coil winding. In any case, the fire risk is effectively counteracted by the early melting down of the insulation.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1:
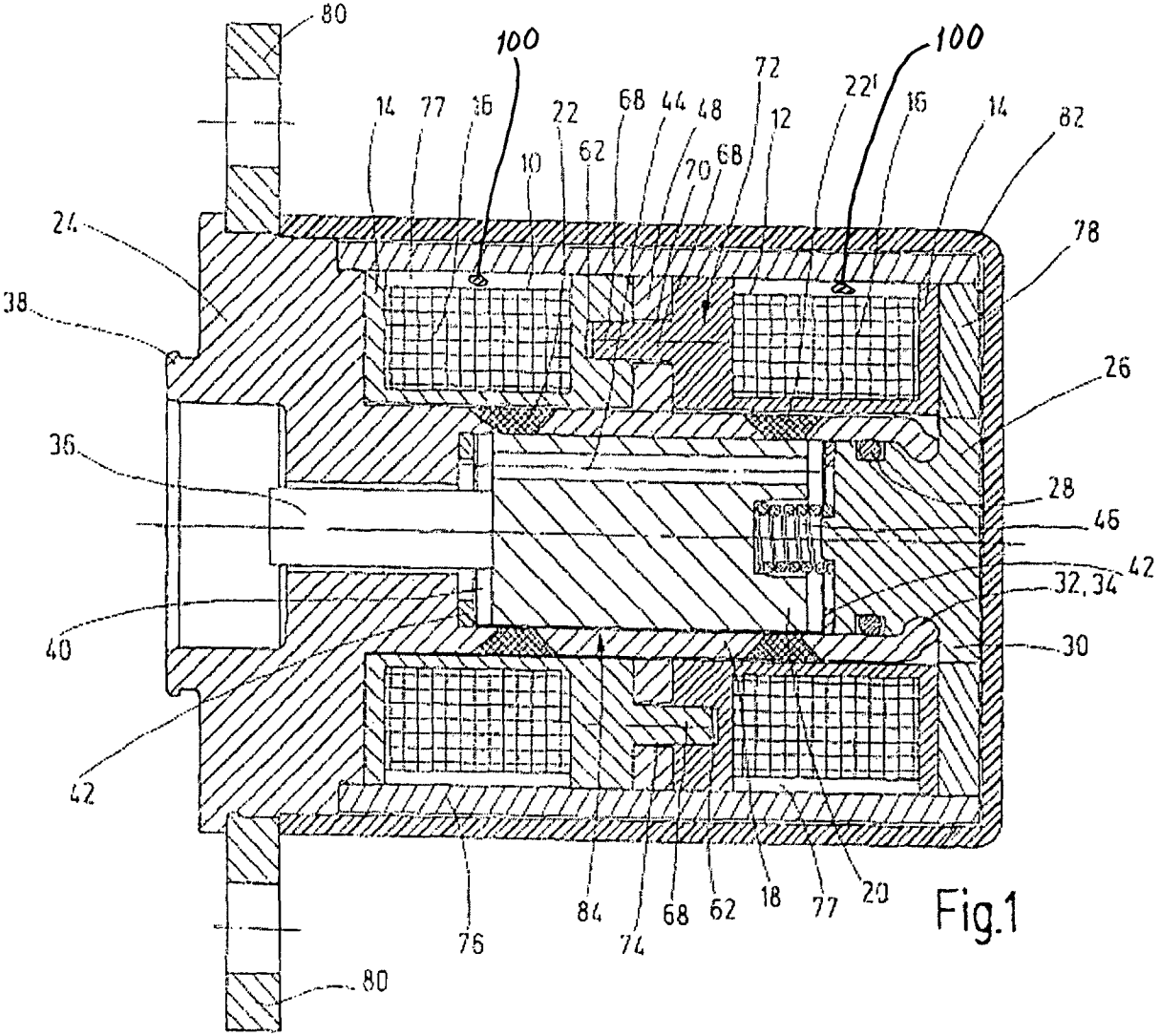
FIG. 1 is a side elevational view in section of a double solenoid according to an exemplary embodiment of the invention.

The operating device shown in FIG. 1 is designed in the form of a double solenoid, in particular in the form of a proportional double solenoid. The proportional double solenoid is used primarily to operate hydraulic or pneumatic valves (not shown in more detail). Comparable operating magnets, also in the form of an individual solenoid, can be used for valve control, but are also used in the activation of safety systems, such as a headrest activation, shown in DE 10 2005 056 816. The operating device shown in FIG. 1 has two coils 10, 12. Each coil 10, 12 is provided with a coil former 14 on which a coil winding 16 is fitted, for example in the form of a coated electric wire, preferably in the form of a copper wire. The design of the respective coils is conventional in magnet technology, so that at this point, no further detail will be provided. The two coils 10, 12 comprise a pole tube 18, in which an anchor part 20 can move longitudinally and is guided to move within.

As viewed in FIG. 1, the pole tube 18 is connected at its front end via a first magnetic separation 22 to the pole core 24 spreading like a flange and on its other side via a second magnetic separation 22' to a closing part 26. Pole tube 18 and pole core 24 are designed in one piece from a magnetically conductive metal material and can be designed, for example, as a rotating part. By machining, groovelike recesses can be formed in the pole tube 18 and then preferably filled via a welding or soldering application process with a magnetically non-conductive material forming the respective magnetic separation 22 or 22'. The closing part 26 is connected behind the second magnetic separation 22' and is provided on its outside circumferential side with an annular groove in which a sealing ring 28 is inserted. Toward the free end, the pole tube 18 is flanged toward the inside. A groovelike recess 32 is provided in the closing part 26 between the anchor part 20 and a shoulder 30 extending like a web from the remainder of the closing part 26. The pole tube end 34 extends in to recess 32 engaging by friction and positive action. The pertinent arrangement between pole tube 18 and closing part 26 in connection with the sealing ring 28 allows a high-pressure application of the double solenoid up to 250 bar and more.

On its front end, the anchor part 20 has an actuating tappet 36 and together with the anchor part form an operating part guided at least partially into the respective coil former 14. The actuating tappet 36 also engages the pole core 24 in the center and is provided for operating a hydraulic valve (not shown) of a safety device for a headrest, etc. The pertinent additional system parts can then be connected via a connecting point 38 to the pole core 24 with the operating device. The anchor part 20 is guided in a receiving space 40 between two anti-adhesive disks 42 helping to prevent magnetic adhesion of the anchor part 20. The receiving space 40 is limited on an outer side by the inner circumferential side of the pole tube 18, on a forward end by the pole core 24, and on the rear end by the closing part 26. In addition, the anchor part 20 has a through-hole 44 producing pressure equalization within the receiving space 40, if the receiving space 40 is divided by the anchor part 20 into two partial spaces. The maximum longitudinal travel of the anchor part 20 is set by the stops in the form of the anti-adhesive disks 42.

As viewed in FIG. 1, the anchor part 20 is supported on the right side on a pressure spring 46. Another pressure spring (not shown) having an opposite biasing effect can be arranged in the hydraulic or pneumatic valve, or in a safety device, optionally to produce a counterforce via the actuating tappet 36 on the anchor part 20. With the application of a force, the anchor part 20, as shown in FIG. 1, can be centered in the middle. The middle-centering position of anchor part 20 can be supported by sending current through both coils 10, 12 via their respective coil winding 16. Travel of the anchor part 20 then takes place in one direction or the other (pulling or pushing) by sending the corresponding additional current through the coil 10 or 12 that can be assigned in each case. Between the two coils 10, 12, a disklike pole plate 48 is arranged likewise encompassing the pole tube 18.

Figure 2:
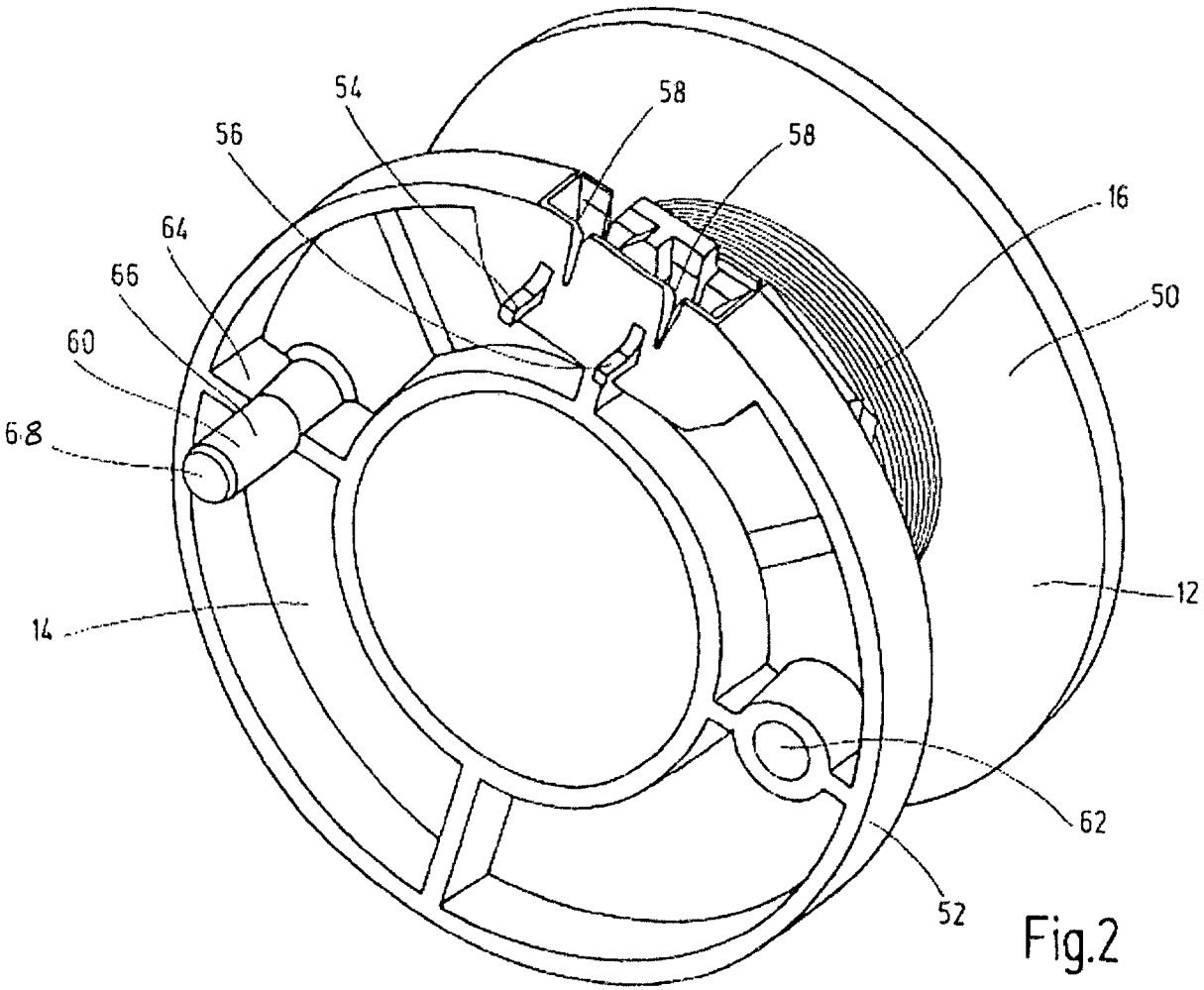
FIG. 2 is a perspective view of an individual coil for the magnets of the double solenoid of FIG. 1, with a coil winding fitted partially to the coil former.

The design of an individual coil 12 is reproduced by way of example in FIG. 2. In addition to the actual coil winding 16, the coil 12 has two ring flanges 50, 52 on the coil former 14. Preferably, the pertinent coil former 14 is formed from an injection-molded part and has two connection points 54, 56 on its top side as viewed in FIG. 2. Via the connecting points, the beginning and end (not shown) of the coil winding 16 can be fixed on the coil former 14. Furthermore, the two connection points 54, 56 are used for the connection of the coil winding 16 to a power supply circuit 57 of the conventional design according to the depictions of FIGS. 3 and 4. For a pertinent electrical connection with the supply circuit 57, in addition, two recesses 58 arranged on the top side of the ring flange 52 are used. The recesses are used in the engagement of a contact device (not shown) to produce the electrical connection of a plug-in part (not shown) of the power supply circuit 57 to the connection points 54, 56. In particular, the respective wire end of the coil winding 16 here engages the ring flange 52 that extends crosswise to the recess 58.

As viewed in FIG. 2 and offset by about 90° in each case relative to the connection points 54, 56, a projecting component 60 is arranged on one side, and a corresponding recess 62 is arranged on the diametrically opposite side. The projecting component 60 is accommodated in a stiffening web 64 formed as a component of the chamber-like ring flange 52. A cylindrical middle part 66 of the projecting component 60 undergoes transition into a contact pin 68 with a conical taper and is connected to this stiffening web 64. The contact pin 68 with a conical taper is provided to engage in the conical recess 62 of the ring flange 52 of the other coil 10, designed as the same part as the coil 12. Also, the cylindrical middle part 66 of the projecting component 60 is used in the penetration of the through-opening 70 in the center pole plate 48. To facilitate the engagement of the projecting component 60 in the respective recess 62, the recess 62 is likewise provided on the inside circumferential side with a corresponding conicity.

The coils 10, 12 designed as like parts are then, as viewed in FIG. 2, to be brought together, offset by 180° relative to one another, via their ring flanges 52 with intermediate accommodation of the pole plate 48 between the adjacent ring flanges 52, to then obtain a coil former design as shown in FIG. 1, and forming another second assembly 72. To be able to have the connection points 54, 56 of any ring flange 52 face one another, a recess 74 is made in the middle pole plate 48 as shown in FIG. 1.

As follows in addition from FIG. 1, the two coils 10, 12 are encased on the outside by a cylindrical jacket 76 of magnetically conducting material. In this embodiment, an annular cavity 77 is formed between the outside circumference of the coil winding 16 and the inside circumferential side of the jacket 76. The cavity 77 can be used, for example, to receive an extinguishing agent or medium 100, as explained in more detail below. The formation of various other cavities would be conceivable, for example, in the area of the connection of the pole tube end 34 to the shoulder 30, extended like a web, of the closing part 26 or in the area of the compression spring 46. The provision of additional cavities for filling with a respective extinguishing medium would be conceivable based on the space available. Also, supplying an extinguishing medium from outside is conceivable, in which a storage container mounted from the outside on the operating magnets is in media-carrying connection with inside parts of the depicted operating apparatus.

The cylindrical jacket 76 is connected on the end side via drive fit with a shoulder-like stage in the pole core 24 and with a pole closing plate 78 supported on at its inner circumferential side on the shoulder 30 of the closing part 26. The pole core 24 has two attachment flanges 80 in the direction of its free end. The flanges have corresponding through-openings for penetration of fastening screws (not shown) for securing valve or safety housing parts (not shown) to which the operating device is to be connected. In this respect, the operating device is also designed in the form of a modular design concept. From the attachment flanges 80, the remainder of the operating apparatus is encased on the outer circumferential side by a housing part 82, which in particular is formed of plastic, can be sprayed onto the other components, preferably in a sealing manner.

The double solenoid is disclosed only by way of example. Instead of the double solenoid, an individual solenoid can also be used, as it is shown in this form or a similar form to that of DE 10 2005 056 816. In this respect, the actuating tappet 36 (not shown) can then also be provided via the free front edge of the operating magnet.

The now presented operating magnet in the form of an operating apparatus is provided according to the invention with a safety apparatus for avoiding a possible fire risk, by at least parts of the operating magnet being equipped with active and/or passive safety means or devices. As active safety devices, for example, extinguishing media can be provided, such as extinguishing foam, extinguishing gas, or extinguishing fluid with inclusion of nanoparticulate extinguishing substances, for example based on gel.

If nitrogen is to be used as an extinguishing gas, melamine or melamine-containing active compounds have proven reliable as nitrogen vehicles. As an extinguishing fluid for the discharge of water, aluminum trihydroxide (ATH) and/or magnesium hydroxide (MDH) in capsule or paste-like form can be used successfully. As an extinguishing foam, ammonium polyphosphates (APP) are suitable, and as nanoparticulate extinguishing substances, silicate and/or graphite can be used, for example, by being integrated in a gel-based substance. The pertinent extinguishing media can be housed in, for example, the cavity 77 between the outside of the respective coil winding 16 and the inside of the jacket 76. Because of the good active sealing situation for the operating magnets, the extinguishing media can also be encapsulated over the long term in the cavity 77. If, for example, a medium connection to the area encasing the operating magnet is created via a hole, the cavity 77 could also be filled initially or else subsequently be refilled from the outside with the extinguishing medium if existing operating equipment is already present. Furthermore, a storage apparatus (not shown) that is mounted on the magnet could permanently provide a fresh supply of extinguishing medium especially in case of an emergency. If a malfunction or failure occurs with strong heating of the coil winding 16, the pertinent extinguishing media are suitable to draw off the heat energy that is produced and to control it.

In addition to or as an alternative to the described active safety devices, passive safety device can also be used, which are characterized in that they have low flammability or have a flame-retardant action. As passive safety devices, especially materials such as the following are used:

ammonium phosphate (AP)
ammonium polyphosphate (APP)
resorcinol bis-diphenylphosphate (PDP)
red phosphorus (RP)
tri-n-butyl phosphate (TBP)
tricresyl phosphate (TCP)
triphenyl phosphate (TPP).

The pertinent materials act in particular when they are at least partial components of the housing, for example in the form of the closing part 26 or in the form of the plastic encapsulation 82 of the housing. Moreover, these materials can be components of the respective coil former 10, 12 or even form the electric jacket insulation of the respective coil winding 16. In particular, when these components are formed from pertinent plastic materials, the passive safety devices can be very well intermixed or used cluster-like even subsequently in the respective plastic walls.

Figure 3:
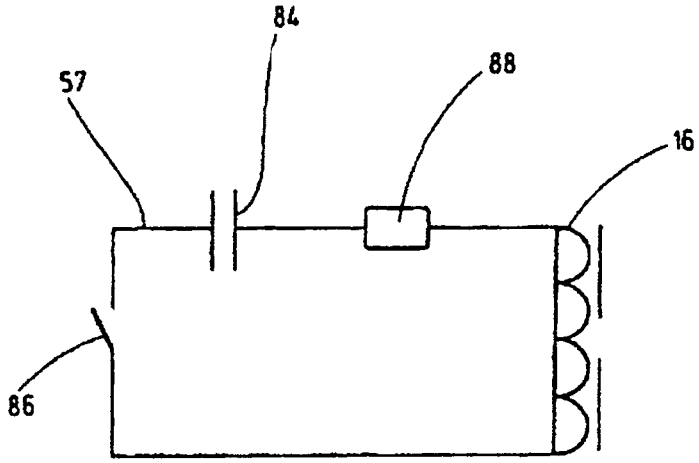
Fig.3 Prior Art
FIG. 3 is a wiring diagram of a power supply for the coil winding of an operating magnet according to the prior art.

In addition to or as an alternative to the described active and passive safety devices, another safety device can be produced in the form of a scoring for creating an early, non-critical failure case for the operating magnets. The pertinent scoring situation is explained in more detail based on the embodiment according to FIGS. 3 and 4. In this case, FIG. 3 shows a solution according to the prior art. As mentioned above, the respective coil winding 16 is connected via a corresponding electrical supply circuit 57 to a power supply source, for example in the form of a battery. By closing a switch 86, the coil winding 16 can be supplied with power via the battery 84 to be able to activate operating processes. In addition, the electric supply circuit 57 is secured via a safety device, such as a fuse 88. It is prior art according to FIG. 3 under normal conditions to select a highly heat-resistant coating insulation according to DIN EN 60317 for the copper wire of the coil winding 16 to ensure high operating safety. This arrangement relies on the heat-resistant coating insulation holding up until the fuse 88 is promptly activated to interrupt the power supply. If no more energy is supplied, the operating magnet can also not burn through or begin to scorch. Unfortunately, this safety concept has not proven its value in practice and in this respect it results in electrical scorching and burning. In the prior art use is usually made of a winding wire according to DIN EN 60317-13 (1994).

Figure 4:
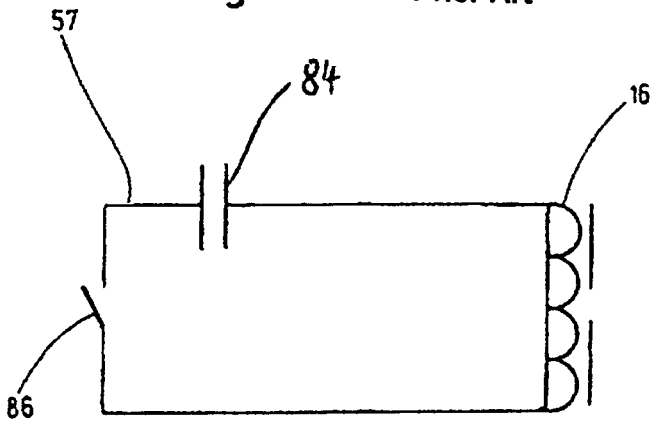
FIG. 4 is a wiring diagram of a power supply for the coil winding of an operating magnet according to the exemplary embodiment of the invention.

In the solution of the invention according to FIG. 4, the coating insulation used for the coil wire has a low softening temperature, such that if even just a little heat builds up within presettable limits, a desired burning-through of the adjacent insulating layers occurs. This coating then has the result that the coil winding 16 is melted together, at least partially, to form a block that includes the individual winding layers, in particular a copper line block. This block is not easily destroyed by heat and in particular disables the operating magnets—which also relates to the additional current consumption. In this case, the additional fuse 88 according to the known solution can even be completely eliminated.

By the premature melting away of the insulation, the possible fire risk at any rate is effectively counteracted. For the coil winding 16, in the solution according to the invention, a winding wire according to DIN EN 60317, 1994 Edition, is inserted according to the parts 1, 2, 3, 4, 12, 19, 20, 21, 34 or a winding wire according to IEC 317, parts 1, 2, 3, 4, 12, 19, 20, 21, 34. The selected insulation material class is then always below a class size of the otherwise used wire insulation. To provide an especially effective safety apparatus, the melting point of the relevant components for the operating magnets or the operating apparatus is above the melting point of the coating insulation used for the electric wire in the form of copper wire. Thus, for example, the winding of copper wire melts with low heat class F at, for example, 130° C., while the coil formers 10, 12 formed essentially of plastic have a melting point of 155° C. Comparable considerations also apply for the heat resistance of the otherwise used plastic components for the operating magnets.

In an especially preferred embodiment, several active and passive safety means or devices can be used for an operating magnet. With the solution according to the invention, it is possible to achieve a clear increase in safety in the operation of pertinent operating magnets.

While one embodiment has been chosen to illustrate the invention, it will be understood by those skilled in the art that various changes and modifications can be made therein without departing from the scope of the invention as defined in the appended claims.

What is claimed is:

1. A safety actuating magnet, comprising:

a housing;

at least one coil former located within said housing an operating part movably mounted and guided in said coil former;

a coil winding having coils fitted on said coil former, said coils of said coil winding having a current-carrying wire surrounded by insulation material bringing about early failure through electric short circuiting of said coils by melting before reaching a critical temperature for possible fire; and at least one passive safety device formed by parts of the actuating magnet inside said housing avoiding a potential fire risk in said housing.

2. A safety actuating magnet according to claim 1 wherein said wire complies with DIN EN 60317, 1994 edition, parts 1, 2, 3, 4, 12, 19, 21 and 34.

3. A safety actuating magnet according to claim 1 wherein said wire complies with IEC 317, parts 1, 2, 3, 4, 12, 19, 21 and 34.

4. A safety actuating magnet according to claim 1 wherein said insulation material coats said wire;

said coil former is formed of a former material having a melting temperature greater than a melting temperature of said insulation material.

5. A safety actuating magnet according to claim 4 wherein said wire is a copper wire.

6. A safety actuating magnet according to claim 1 wherein said passive safety device comprises one of flame resistant material and flame retardant material.

7. A safety actuating magnet according to claim 1 wherein said passive safety device comprises a predetermined breaking point causing an early non-critical failure of the actuating magnet.

8. A safety actuating magnet according to claim 1 wherein said passive safety device comprises at least one of components of said housing, said coil former and said insulation material formed of the group consisting of ammonium phosphate, ammonium polyphosphate, resorcinol bis-diphenylphosphate, red phosphor, tri-n-butyl phosphate, trieresyl phosphate and triphenyl phosphate.

9. A safety actuating magnet according to claim 1 wherein a power supply circuit is electrically connected to said coil winding without electrical safeguard.

10. A safety actuating magnet according to claim 1 wherein a power supply circuit is electrically connected to said coil winding without a fuse.

11. A safety actuating magnet according to claim 1 wherein an active safety device comprising an extinguishing medium is provided in said housing.

12. A safety actuating magnet according to claim 11 wherein said extinguishing medium is selected from the group consisting of extinguishing foam, extinguishing gas and extinguishing fluid.

13. A safety actuating magnet according to claim 11 wherein said extinguishing medium includes nanoparticulate extinguishing substances.

14. A safety actuating magnet according to claim 11 wherein said extinguishing medium is nitrogen gas with at least one of melamine and melamine active compounds used as nitrogen vehicles.

15. A safety actuating magnet according to claim 11 wherein said extinguishing medium comprises at least one of aluminum trihydroxide and magnesium hydroxide used as an extinguishing fluid for discharge of water.

16. A safety actuating magnet according to claim 11 wherein said extinguishing medium is a foam of ammonium polyphosphate.

17. A safety actuating magnet according to claim 13 wherein said nanoparticulate extinguishing substances comprise at least one of silicates and graphite.

* * * * *